US007914165B2

(12) United States Patent
Bertken

(10) Patent No.: US 7,914,165 B2
(45) Date of Patent: Mar. 29, 2011

(54) BEVERAGE BOTTLE WITH ACCESSORIES

(75) Inventor: Dennis Bertken, Encinitas, CA (US)

(73) Assignee: Life+Gear, Inc., Solana Beach, CA (US)

( * ) Notice: Subject to any disclaimer, the term of this patent is extended or adjusted under 35 U.S.C. 154(b) by 171 days.

(21) Appl. No.: 12/237,277

(22) Filed: Sep. 24, 2008

(65) Prior Publication Data

US 2009/0080180 A1 Mar. 26, 2009

Related U.S. Application Data

(60) Provisional application No. 60/975,126, filed on Sep. 25, 2007.

(51) Int. Cl.
*F21V 33/00* (2006.01)

(52) U.S. Cl. ..... 362/101; 362/97.3; 362/154

(58) Field of Classification Search ..... 362/86–88, 362/96, 101, 118, 149, 154–157, 183, 184, 362/200, 202, 205, 208, 249.02, 249.12, 362/249.16

See application file for complete search history.

(56) References Cited

U.S. PATENT DOCUMENTS 4,792,994 A * 12/1988 Aylward ..... 455/344
4,858,083 A * 8/1989 Wakimoto ..... 362/101
5,165,781 A * 11/1992 Orak ..... 362/186
5,584,823 A * 12/1996 Valberg ..... 604/294
5,662,406 A * 9/1997 Mattice et al. ..... 362/101
6,000,811 A * 12/1999 Bordak ..... 362/158
6,004,004 A * 12/1999 Altman et al. ..... 362/191
6,158,870 A * 12/2000 Ramirez ..... 362/101
6,213,616 B1 * 4/2001 Chien ..... 362/84
6,778,813 B1 * 8/2004 Lilly ..... 455/90.3
7,175,294 B1 * 2/2007 Estrada et al. ..... 362/101
7,613,431 B2 * 11/2009 Brand ..... 455/90.3
2006/0219858 A1 * 10/2006 Iacovino ..... 248/311.2
2009/0166378 A1 * 7/2009 Stilley ..... 222/39

* cited by examiner

*Primary Examiner* — Hargobind S Sawhney

(74) *Attorney, Agent, or Firm* — Marger Johnson & McCollom, P.C.

(57) ABSTRACT

A configurable beverage container comprises a container body defining a central axis and bounded by non-opaque sides, an openable top, and a bottom defining a cavity in which a liquid can be retained. The container body includes a connector, such as a set of female thread portions, located on a lower end of the container body adjacent the container body bottom. The configurable container further includes an accessory having an accessory connector (e.g. male thread) located on a top end thereof and another (e.g. female thread) on a bottom thereof, with the top end configured to be coupled to the container body connector along a long axis of the container body. Examples of accessories include a first-aid kit, a GPS, a power source, and a flashlight. The flashlight accessory may further include an inward-shining light adapted to shine into the beverage container cavity and turn it into a lantern. Multiple accessories may be coupled in serial fashion in any configuration.

6 Claims, 7 Drawing Sheets

| | BOTTLE WATER MARKET | OUTDOOR/ SPORTS MARKET | EMERGENCY PREPAREDNESS MARKET |
|---|---|---|---|
| DISPOSABLE BOTTLE | X | | |
| REUSABLE BOTTLE | X | X | X |
| AM/FM RADIO WITH SPEAKER | X | X | X |
| WATERPROOF STORAGE UNIT | X | X | X |
| LED FLASHLIGHT ON BOTTLE | | X | X |
| WEATHER CHANNELS/NOAA | | | X |
| EMERGENCY ACCESSORIES INSIDE | | | X |

BEVERAGE BOTTLE WITH ACCESSORIES

BACKGROUND OF THE INVENTION

This invention relates generally to containers and more particularly to a container having modular accessories that can be added as needed depending upon the intended use of the container.

People often carry beverage bottles with them. Depending upon that day's activities, they may also carry a variety of small accessories. For example, people participating in outdoor sports or recreation may also carry accessories such as an AM/FM radio or MP3 player with a speaker, a storage unit, a flashlight, a GPS unit, a compass, a stopwatch or clock, or a pedometer. In addition to these accessories, people concerned about emergency preparedness may also carry a radio that can access NOAA alerts or other weather channels, a first aid kit or other emergency accessories, or a two-way communication device. Moreover, any person using electronic accessories will also need to carry batteries, a solar collecting device, other power sources, or a manual power supply (such as a hand-crank power-generating device) for generating power or recharging batteries. In general, any beverage bottle user may have a need for any or all of these and other accessories.

Carrying a beverage bottle and any or all of these and other accessories adds to the overall bulk of a person's belongings. Moreover, a person may bring some multiple accessories having the same feature. For example, a person may bring a clock/radio combination to tell time and an MP3/radio combination for listening to music. Carrying redundant accessories also adds to the bulk of the person's belongings.

The ability to make dual use of a bottle for storing a beverage and as a receptacle for attaching one or all of these and other accessories would be a significant advantage to beverage bottle users, including users participating in recreational activities and sports and users concerned with emergency preparedness, and users with special medication needs. It would, among other benefits, reduce the bulk, space, and weight of belongings, improve organization of accessories, and provide convenient access to a beverage bottle and accessories. It would also reduce the amount of redundant accessories that add bulk to the person's belongings.

SUMMARY OF THE INVENTION

In various representative aspects, the present invention describes a bottle-and-accessory aggregate along with methods of using such aggregates.

Exemplary implementations include a beverage bottle for storing and dispensing drinking water or other liquids or solids attached to any combination of one or more optional accessories, for example, audio devices, storage devices, recreational devices, lighting devices (both an outward-facing flashlight and an inward-facing lantern), power sources, emergency items, clocks, timers, alarms, and medicine dispensing needs. In certain embodiments, the bottle can be disposable, made of lightweight plastic, reusable, and be made of a transparent or translucent material such as Nalgene/Lexan.

The accessories can be attached in many combinations including but not limited to: bottle with radio feature; bottle with radio feature and flashlight; bottle with flashlight only; bottle with digital clock and alarm feature; bottle with digital clock, alarm, and radio feature; bottle with digital clock, alarm, radio, and flashlight; bottle with medicine dispenser; bottle with medicine dispenser and flashlight; bottle with medicine dispenser, radio and flashlight; or bottle with medicine dispenser, digital clock, alarm, and flashlight.

In another exemplary implementation, a user can detach an accessory from the beverage bottle. The user can, for example, detach all accessories from the beverage bottle and use the beverage bottle in a stand alone configuration. In an exemplary implementation, the instrumentality for attaching accessories to the beverage bottle will be concealed so that no instrumentality for attachment is visible when all accessories are detached from the bottle. The ability to detach an accessory from the beverage bottle can allow the user to substitute a different accessory by attaching that different accessory to the beverage bottle. For example, there can exist a range of accessories that can be attached to the beverage bottle. For example, there can exist a range of accessories that can be attached to the beverage bottle that use the same instrumentality. Therefore, each accessory in the range of accessories would be suitable for one another, and a user could form various aggregates from the same beverage bottle by detaching and attaching various accessories.

In still another exemplary implementation, a user can attach more than one accessory to the beverage bottle. For example, there could exist a range of accessories that can be attached to the beverage bottle or to other accessories using the same instrumentality. These accessories could also, for example, be detached from the beverage bottle or from other accessories. In one exemplary implementation, each accessory in the range of accessories could be substitutable for one another and could be detached from or attached to each other or to the beverage bottle in any configuration. For example, the user could link accessories by attaching one accessory to another in a serial configuration and then the user could attach an accessory at the end of the serial accessories to the beverage bottle. This would allow a user to create a single aggregate of water bottle and multiple accessories linked together in a serial configuration. However, any configuration for attaching more than one accessory to a water bottle would be appropriate and any instrumentality for connecting accessories to each other and to the beverage bottle could be used.

There are a variety of techniques for attaching accessories to the beverage bottle and to each other. One or more of these accessories can be attached to the beverage bottle, for example, by screwing one accessory to the bottle and other accessories to each other. The accessories can also snap into the bottle and to each other or can be attached by fasteners. The accessories can be attached to the bottle by frictional engagement. Any technique for securing one object to another, including permanent techniques for fixing objects to each other, is suitable for securing one or more accessories to the beverage bottle and to each other.

The aggregates can be customized by users or by marketers. A user can, for example, create an aggregate of a beverage bottle and one or more accessories that meets the user's needs by selecting certain accessories from a range of accessories based upon the user's desired activity and attaching these one or more accessories to the beverage bottle. For example, if the user is going on a day hike, the user may select a compass, a storage compartment, a flashlight, and a portable power source from a range of accessories. The user can then attach these accessories to the beverage bottle. As another example, a marketer can create an aggregate of a beverage bottle and one or more accessories that targets a certain market segment's needs. For example, the marketer can pre-select certain accessories from a range of accessories and sell a beverage bottle bundled together with these accessories. A marketer could, for example, target the emergency preparedness market by selecting a first-aid kit, a GPS, a power source, and a flashlight from a range of possible accessories. The marketer can then attach these accessories to the beverage bottle and market the aggregate to particular users interested in emergency preparedness.

The features of the aggregates can be combined to address specific price points and market segments. These market segments include, among others, the general consumer bottle water market; the outdoor, recreational, and sports market; the safety and emergency preparedness markets; and the market for consumers requiring medication. For the emergency preparedness market, an aggregate can also include safety and emergency items inside the bottle for storage, distribution, and easy access in case of an emergency. For the outdoor, recreational, and sports market, an aggregate can also include items commonly used for outdoor activity such as camping and hiking stored inside the bottle. The items will be packaged with the aggregate bottle and accessories as a complete solution to address the specific market.

Additional advantages will be set forth in part in the description which follows, and in part will be obvious from the description, or may be learned by practice. Other advantages will be realized and attained through the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying figures, which are incorporated in and constitute a part of this specification, illustrate several embodiments and together with the description serve to explain the principles of the invention.

DETAILED DESCRIPTION OF EXEMPLARY EMBODIMENTS

In the following description, for the purposes of explanation, numerous specific details are set forth in order to provide a thorough understanding of the various aspects of the present invention. It will be obvious, however, to one skilled in the art that the present invention may be practiced without these specific details. In other instances, well-known structures and devices are shown or discussed generally in order to avoid obscuring the present invention or making the specification unnecessarily long. IN that regard, in order to further shorten the specification, numerous existing patents and publications are discussed and incorporated by reference above and below. It should be noted that there exist many different configurations, technologies, and applications to which the present invention may be applied and that, while exemplary embodiments are used to illustrate and explain the various aspects of the invention, application of the various aspects of the invention is not limited to those embodiments.

Figure 1:
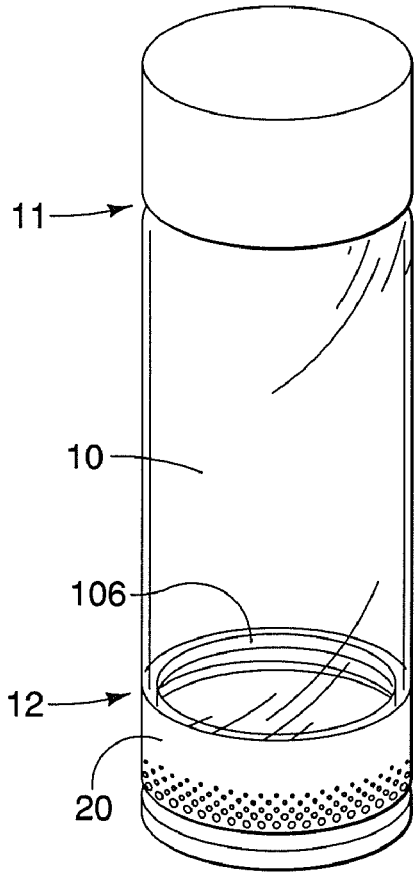
FIG. 1 representatively illustrates an embodiment of an aggregate bottle and accessory attachment.

FIG. 1 representatively illustrates an embodiment of a bottle aggregate with an accessory attachment. A bottle body 10 has a first extremity 11 for dispensing the contents of the bottle and a second extremity 12 opposite the first extremity. An accessory 20 is attached to second extremity 12 of the bottle body.

Figure 2:
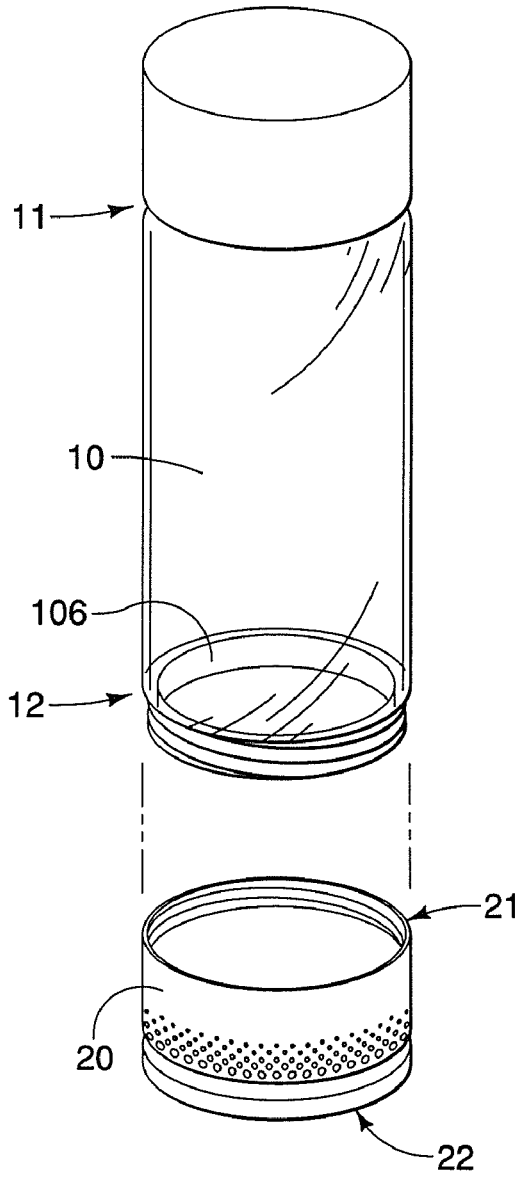
FIG. 2 representatively illustrates an embodiment of an aggregate where the accessory attachment is shown exploded from the bottle.

FIG. 2 representatively illustrates an embodiment of a bottle aggregate with the accessory attachment removed. A bottle body 10 has a first extremity 11 for dispensing the contents of the bottle and a second extremity 12 opposite the first extremity 11. An accessory 20 is detached from the second extremity 12 of the bottle body.

Figure 3:
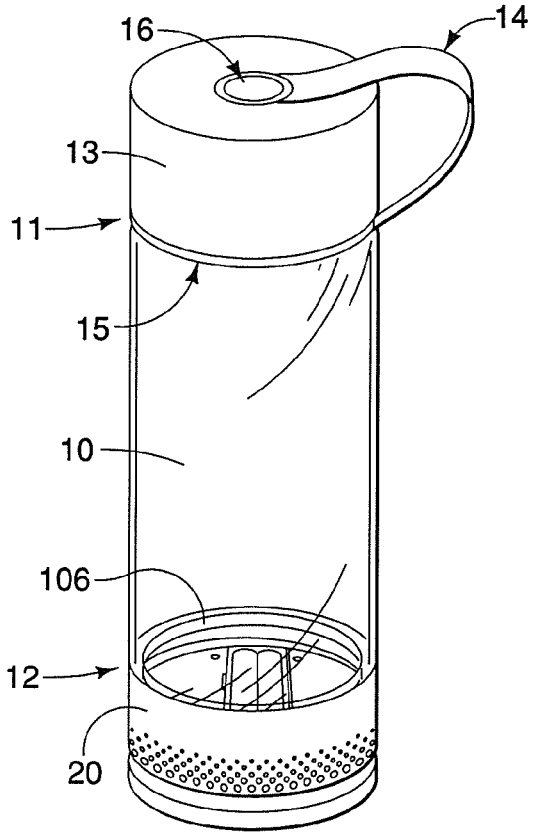
FIG. 3 representatively illustrates an embodiment of an aggregate having a cap attached to the bottle body.

FIG. 3 representatively illustrates an embodiment of a bottle aggregate having a cap attached to the bottle body. A bottle body 10 has a first extremity 11 for dispensing the contents of the bottle and a second extremity 12 opposite the first extremity 11. The first extremity 11 is covered by a removable cap 13. A connector element 14 attaches the cap 13 to the first extremity 11 of the bottle body. In one embodiment, there is an annular groove at the first extremity of the bottle body. An annular ring 15 is situated inside the groove. There is a fastener 16 on the cap. The connector element 14 joins the annular ring 15 to the fastener 16. The connector element 14 permits the cap 13 to remain attached to the bottle body 10 even if the user removes the cap from the first extremity 11. The connector element 14 can also serve as a carrying handle. An accessory 20 is attached to the second extremity 12 of the bottle body.

Figure 4:
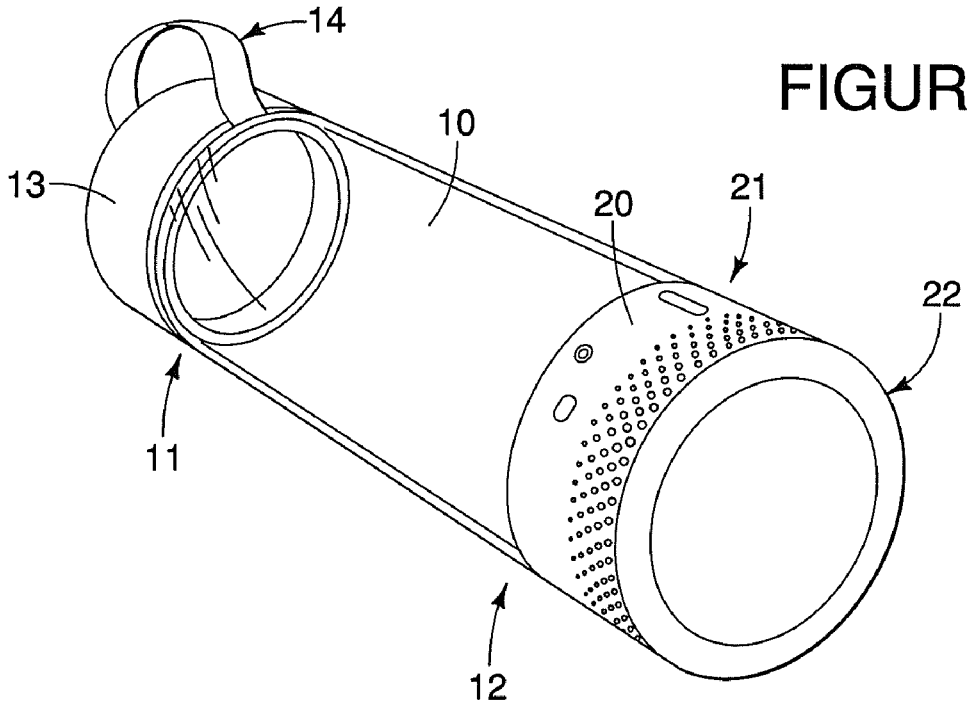
FIG. 4 representatively illustrates another embodiment of an aggregate having a cap attached to the bottle body.

FIG. 4 representatively illustrates an embodiment of a bottle aggregate having a cap attached to the bottle body. A bottle body 10 has a first extremity 11 for dispensing the contents of the bottle and a second extremity 12 opposite the first extremity 11. The first extremity 11 is covered by a removable cap 13. A connector element 14 attaches the cap 13 to the first extremity 11 of the bottle body. This permits the cap to remain attached to the bottle body even if the user removes the cap from the first extremity. The connector element can also serve as a carrying handle. An accessory 20 is attached to the second extremity 12 of the bottle body. FIG. 4 further illustrates that the accessory 20 may be a flashlight.

Figure 5:
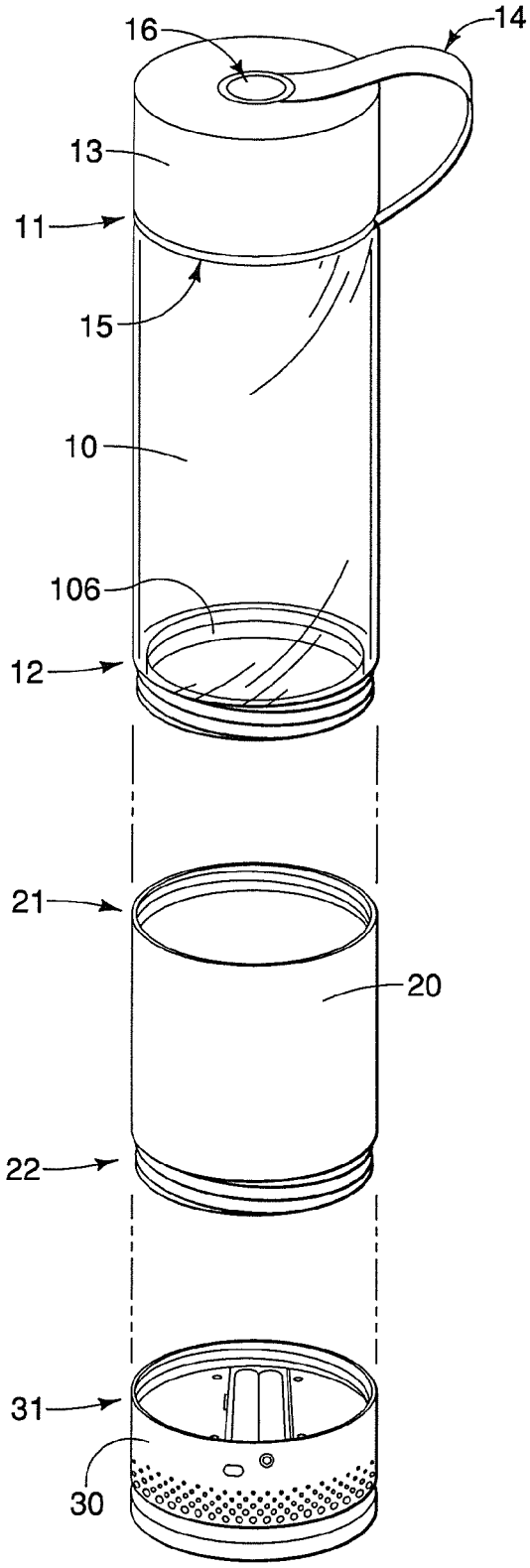
FIG. 5 representatively illustrates an embodiment of an aggregate with more than one accessory attached to the bottle, but shown in exploded form.

FIG. 5 representatively illustrates an embodiment of a bottle aggregate with more than one accessory attached. A bottle body 10 has a first extremity 11. The first extremity 11 is covered by a removable cap 13. A connector element 14 attaches the cap 13 to the first extremity of the bottle body. An annular ring 15 is situated inside the groove. There is a fastener 16 on the cap. The connector element 14 joins the annular ring 15 to the fastener 16. This permits the cap to remain attached to the bottle body even if the user removes the cap from the first extremity. The connector element can also serve as a carrying handle. A first accessory 20 has a first extremity 21 and a second extremity 22 opposite the first extremity 21. The first extremity 21 of the first accessory is attached to the second extremity 12 of the bottle body. A second accessory 30 has a first extremity 31. The first extremity 31 of the second accessory is attached to the second extremity 22 of the first accessory. FIG. 5 further illustrates that the first accessory 20 may be a storage container. FIG. 5 further illustrates that the second accessory 30 may be a radio.

Figure 6:
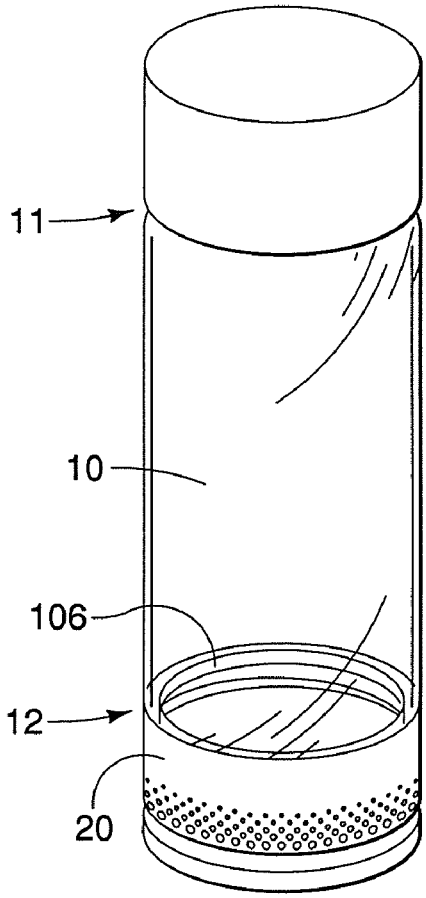
FIG. 6 representatively illustrates another embodiment of an aggregate bottle with accessory attachment.

FIG. 6 representatively illustrates an embodiment of a bottle aggregate with an accessory attachment. A bottle body 10 has a first extremity 11 for dispensing the contents of the bottle and a second extremity 12 opposite the first extremity 11. An accessory 20 is attached to the second extremity 12 of the bottle body.

Figure 7:
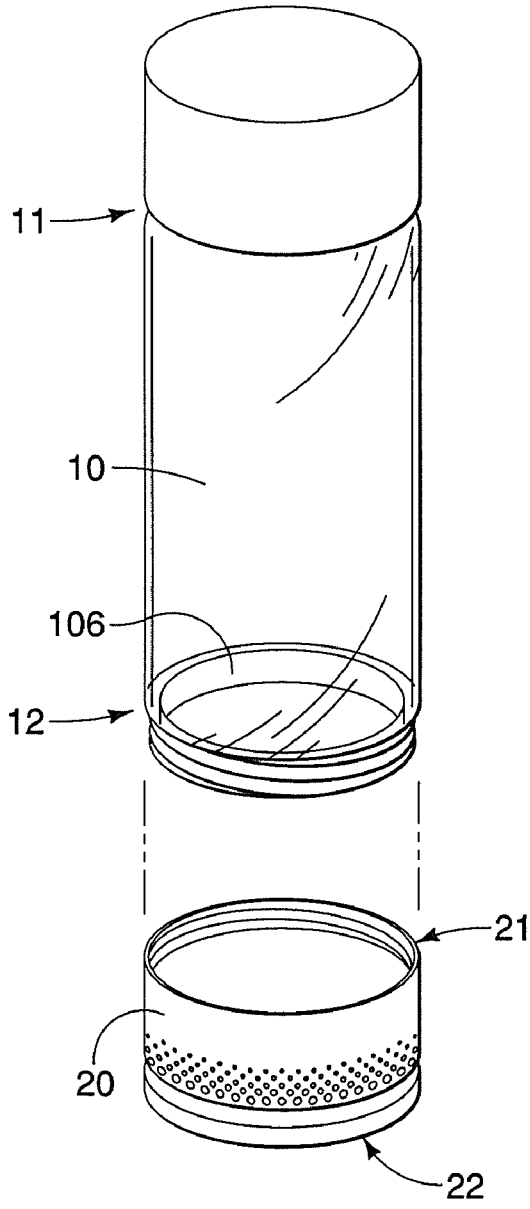
FIG. 7 representatively illustrates a technique for attaching an accessory to the bottle.

FIG. 7 representatively illustrates a technique for attaching an accessory to the bottle aggregate. A bottle body 10 has a first extremity 11 for dispensing the contents of the bottle and a second extremity 12 opposite the first extremity 11 having a perimeter. The perimeter of the second extremity 12 of the bottle body is threaded. An accessory 20 has a first extremity 21 having a perimeter substantially the same as the perimeter of the second extremity 12 of the bottle body. The accessory has a second extremity 22 opposite the first extremity 21. The perimeter of the first extremity 21 of the accessory has threads that correspond to the threads in the second extremity 12 of the bottle body. This allows the first extremity 21 of the accessory to be screwed into second extremity 12 of the bottle body. In one embodiment, the threads in the perimeter of the second extremity 12 of the bottle body are not exposed. Instead, an inner perimeter surface of a lip at the second extremity 12 of the bottle body is threaded. Thus, in that embodiment, if the accessory is removed there are no threads visible on the outer surface of the bottle body 10.

Figure 8:
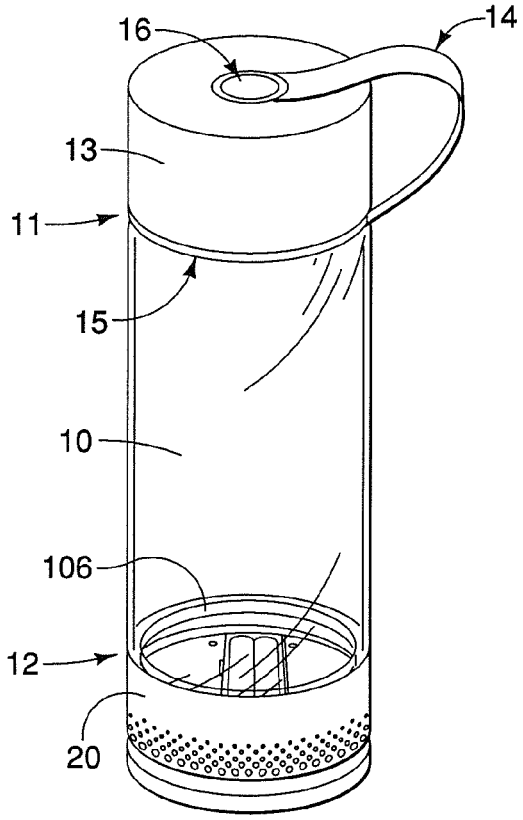
FIG. 8 representatively illustrates another embodiment of an aggregate having a cap attached to the bottle body.

FIG. 8 representatively illustrates an embodiment of a bottle aggregate having a cap attached to the bottle body. A bottle body 10 has a first extremity 11 for dispensing the contents of the bottle and a second extremity 12 opposite the first extremity 11. The first extremity 11 is covered by a removable cap 13. A connector element 14 attaches the cap 13 to the first extremity 11 of the bottle body. In one embodiment, there is an annular groove at the first extremity of the bottle body. An annular ring 15 is situated inside the groove. There is a fastener 16 on the cap. The connector element 14 joins the annular ring 15 to the fastener 16. This permits the cap to remain attached to the bottle body even if the user removes the cap from the first extremity. The connector element can also serve as a carrying handle. An accessory 20 is attached to the second extremity 12 of the bottle body. In one embodiment, the accessory 20 is a radio. In another embodiment, the accessory 20 contains an LED or other light source that shines upward into the bottle body.

Figure 9:
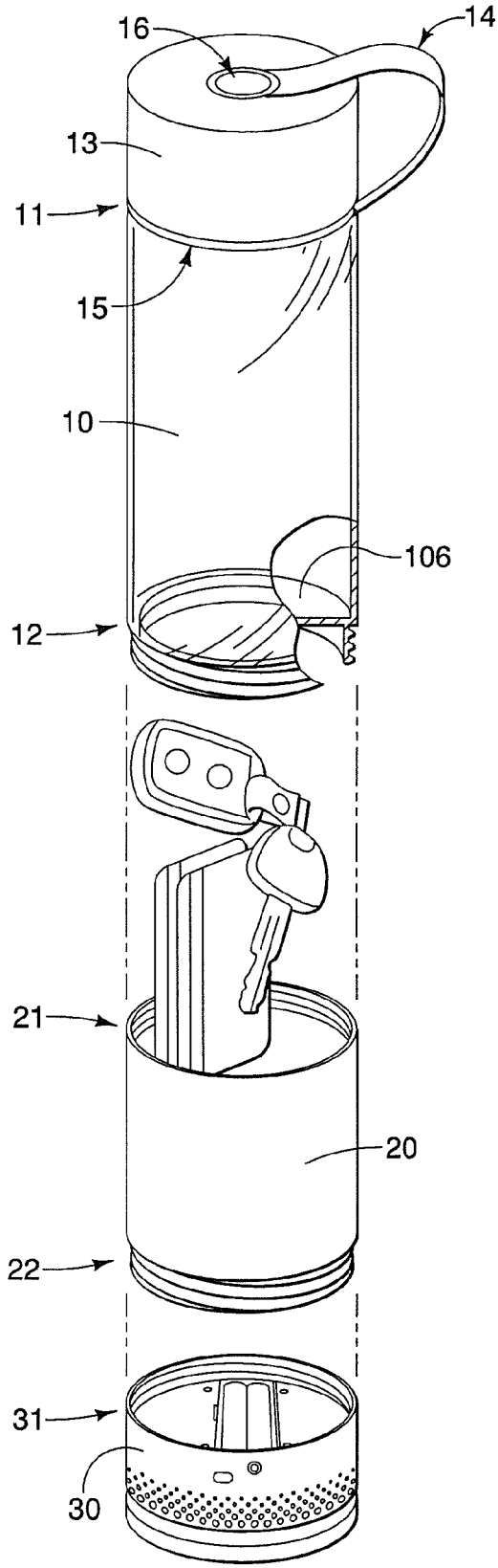
FIG. 9 representatively illustrates a technique for attaching more than one accessory to the bottle.

FIG. 9 representatively illustrates a technique for attaching more than one accessory to the bottle aggregate. A bottle body 10 has a first extremity 11 for dispensing the contents of the bottle and a second extremity 12 opposite the first extremity 11 having a perimeter. The first extremity 11 is covered by a removable cap 13. A connector element 14 attaches the cap 13 to the first extremity 11 of the bottle body. In one embodiment, there is an annular groove at the first extremity of the bottle body. An annular ring 15 is situated inside the groove. There is a fastener 16 on the cap. The connector element 14 joins the annular ring 15 to the fastener 16. This permits the cap to remain attached to the bottle body even if the user removes the cap from the first extremity. The connector element can also serve as a carrying handle. The perimeter of the second extremity 12 of the bottle body is threaded. A first accessory 20 has a first extremity 21 having a perimeter substantially the same as the perimeter of the second extremity 12 of the bottle body. The perimeter of the first extremity 12 of the first accessory has threads that correspond to the threads in the second extremity 12 of the bottle body. This allows the first extremity 21 of the accessory to be screwed into the second extremity 12 of the bottle body. The first accessory has a second extremity 22 opposite the first extremity 21 having a perimeter. The second extremity 22 of the first accessory is threaded around the perimeter. A second accessory 30 has a first extremity 31 having a perimeter substantially the same as the perimeter of the second extremity 22 of the first accessory. The perimeter of the first extremity 22 of the second accessory has threads that correspond to the threads in the second extremity 22 of the first accessory. This allows the first extremity 31 of the second accessory to be screwed into the second extremity 22 of the first accessory. The threading portions may be oppositely disposed so that extremities 11, 21, 31, etc. have male threads while extremities 12, 22, 32, etc. have corresponding female threads that are standardized with each other to couple to their male thread counterparts.

FIG. 9 further illustrates that the first accessory 20 may be a storage container. In one embodiment, the storage container is waterproof. In another embodiment, the storage container is large enough to accommodate keys and money. In yet another embodiment, the storage container is large enough to accommodate credit cards.

FIG. 9 further illustrates that the second accessory 30 may be a radio. In one embodiment of the radio, the first extremity 31 of the second accessory has a plastic cover to seal a battery compartment. In another embodiment of the radio, there is enough space between the second extremity 21 of the first accessory and the battery compartment in the second accessory 30 to store money and a key. In still another embodiment, the radio has splash-proof speaker holes. In other embodiments, the radio can include a channel indicator, an AM/FM tuner, weather channels or NOAA alerts, or volume control.

Figures 10, 11:
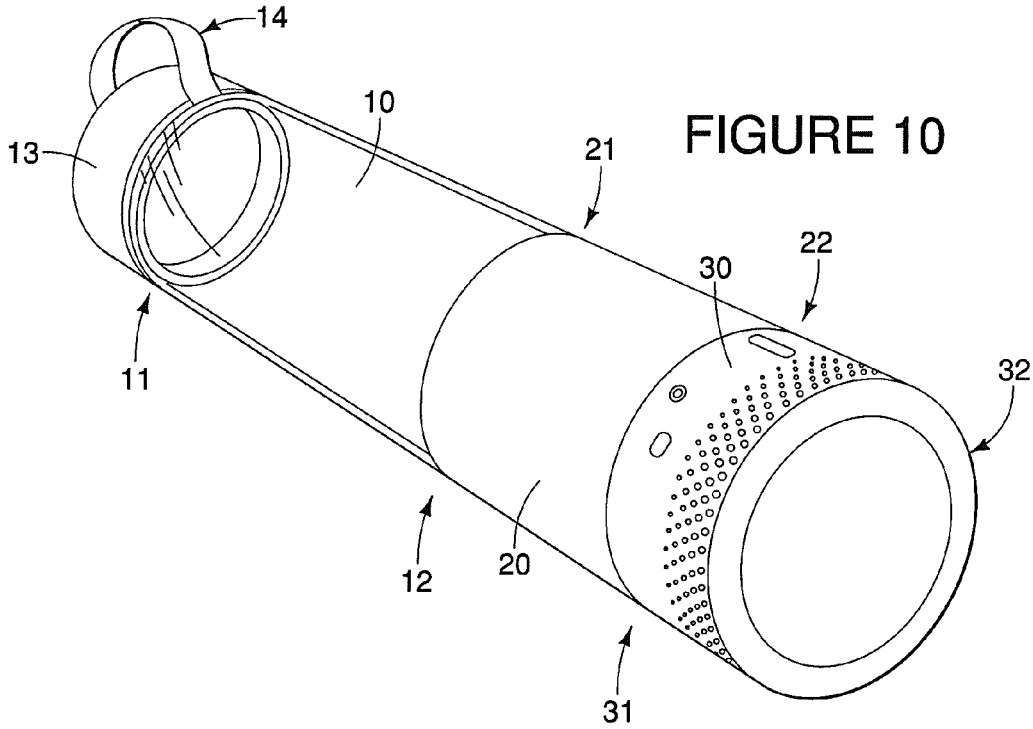
FIG. 10 representatively illustrates another embodiment of an aggregate with more than one accessory attached to the bottle.
FIG. 11 representatively illustrates a table showing examples of combinations of accessories that can be marketed to various market segments.

FIG. 10 representatively illustrates an embodiment of a bottle aggregate with more than one accessory attached. A bottle body 10 has a first extremity 11 for dispensing the contents of the bottle and a second extremity 12 opposite the first extremity. The first extremity 11 is covered by a removable cap 13. A connector element 14 attaches the cap 13 to the first extremity of the bottle body. This permits the cap to remain attached to the bottle body even if the user removes the cap from the first extremity. The connector element can also serve as a carrying handle. A first accessory 20 has a first extremity 21 and a second extremity 22 opposite the first extremity 21. The first extremity 21 of the first accessory is attached to the second extremity 12 of the bottle body. A second accessory 30 has a first extremity 31 and a second extremity 32 opposite the first extremity 31. The first extremity 31 of the second accessory is attached to the second extremity 22 of the first accessory. FIG. 10 further illustrates that the second extremity 32 of the second accessory may include a flashlight.

Figure 12:
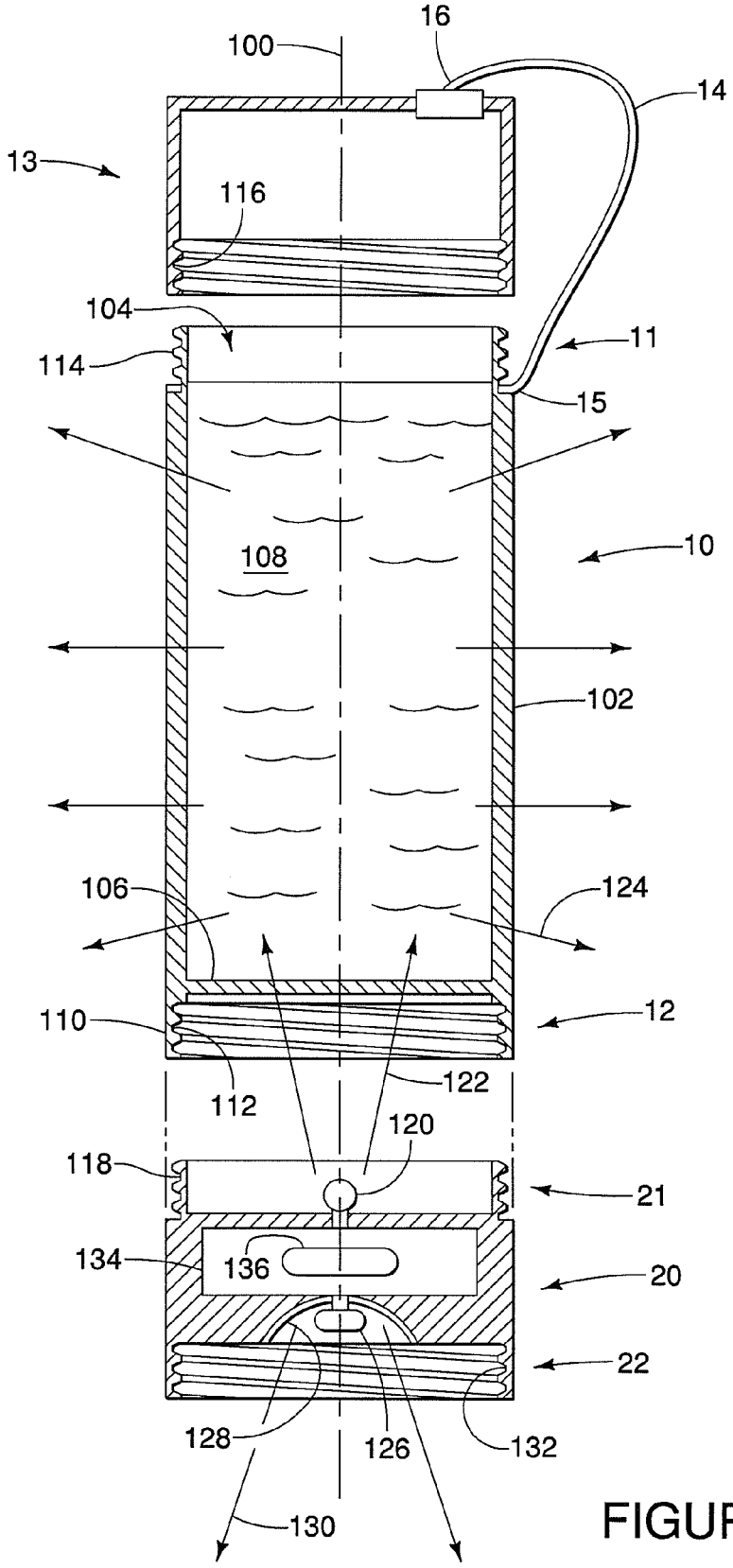
FIG. 12 is an exploded section view of the aggregate of FIG. 3.

FIG. 11 representatively illustrates some examples of combinations of accessories that can be marketed to various market segments. The aggregates can be customized by users or by marketers. A user can, for example, create an aggregate of a beverage bottle and one or more accessories that meets the user's needs by selecting certain accessories from a range of accessories based upon the user's desired activity and attaching these one or more accessories to the beverage bottle. For example, if the user is going on a day hike, the user may select a compass, a storage compartment, a flashlight, and a portable power source from a range of accessories. The user can then attach these accessories to the beverage bottle. As another example, a marketer can create an aggregate of a beverage bottle and one or more accessories that targets a certain market segment's needs. For example, the marketer can preselect certain accessories from a range of accessories and sell a beverage bottle bundled together with these accessories. A marketer could, for example, target the emergency preparedness market by selecting a first-aid kit, a GPS, a power source, and a flashlight from a range of possible accessories. The marketer can then attach these accessories to the beverage bottle and market the aggregate to particular users interested in emergency preparedness FIG. 12 illustrates a section view of a configurable beverage container in exploded form. The container includes a container body 10 defining a central or long axis 100 and bounded by sides, such as cylindrical sides 102, an openable top 104, and a bottom 106 defining a cavity 108 in which a liquid can be retained. In a preferred embodiment, the container body sides 102 are non-opaque (e.g. transparent or translucent, and colored or not colored) so as to allow light to shine through the sides.

Container body 10 includes a connector 110 located on a lower end 12 of the container body 10 adjacent the container body bottom 106. In a preferred embodiment, and as shown in FIG. 12, connector 110 is a female threaded portion 112 formed on inside walls forming a periphery of the bottom portion of the container body.

The container body 10 has a top portion 11 for dispensing the contents of the bottle having a cylindrical perimeter. Threaded portions 114, formed about the periphery of the top portion 11, mate with complementary threaded portions 116 formed on inside walls of removable cap 13. A connector element 14 attaches the cap 13 to the first extremity 11 of the bottle body.

In one embodiment, there is an annular groove at the first extremity of the bottle body. An annular ring 15 is situated inside the groove. There is a fastener 16 on the cap. The connector element 14 joins the annular ring 15 to the fastener 16. This permits the cap to remain attached to the bottle body even if the user removes the cap from the first extremity. The connector element can also serve as a carrying handle.

A first accessory 20, attachable to the container body 10 along its long axis 100, is shown detached from the configurable beverage container in exploded form. First accessory 20 has a first accessory connector 21 located on a top end thereof. In a preferred embodiment, connector 21 is implemented in a male threaded portion 118 formed on outside walls forming a periphery of a top portion of the first accessory. Portions 118 and 112 are complementary threaded portions configured to be coupled to one another. That is, male threaded portion 118 mates with female threaded portion 112 formed on inside walls of the bottom of the container body 10 to form an aggregate device. The aggregate device preferably is bound by a common cylindrical periphery so that, when attached, the first (and second, etc.) accessory appears to be unitary with the container body 10 and part of the same whole.

In one embodiment, the first accessory 20 includes an inward-facing light source 120 configured to shine upward 122 into the cavity 108 of the container body 10 and outward 124 through the non-opaque sides 102 of the container body to thereby illuminate liquid (or other objects) stored within the cavity 108. The liquid within the cavity serves as a light dispersal mechanism that enhances the lantern effect caused by the inward-facing light source 120.

The embodiment may also include an outwardly-facing light source 126 arranged in the first accessory 20 on a side opposite the top end on which the first accessory connector 21 is located. Outwardly-facing light source 126 includes a light concentrating mechanism, such as parabolic mirror 128, for casting light in a beam outward 130 from the aggregate so that it serves a flashlight function.

The first accessory further includes a connector 132 located adjacent a bottom end of the first accessory. In a preferred implementation, the connector includes a female thread portion formed on inside walls forming the periphery of the bottom end 22 of the first accessory 20. The female threaded portion 132 of the first accessory 20 is most preferably identical to the female threaded portion 112 of the container body 10 so that, as will be appreciated below, multiple accessories can be daisy chained in serial fashion in any order.

Accessory 20 includes an electronic portion 134 encompassing a power source (e.g. battery compartment) to drive the light sources 120 and 126. The electronic portion further includes an external button 136 for actuating the light sources 120 and 126, and further may include a switching mechanism for alternately actuating the light source 120 separately from light source 126. The switching mechanism may, for example, operate light source 126 (flashlight) upon a first button press, operate light source 120 (lantern) upon a second button press, both light sources 120 and 126 upon a third button press, flashing one or both light sources upon a forth button press, and both sources off upon a fifth button press. The cycle is then started anew.

And although not shown in FIG. 12, the aggregate can further include a second (and more) accessory having a second accessory connector located on a top end thereof. The connector is configured to be coupled to the connector 132 located on the bottom end 22 of the first accessory 20 along the long axis 100 of the container body 10. The second accessory connector is a male threaded portion, similar to the male threaded portion 118 on the first accessory 20, formed on outside walls forming a periphery of a top portion of the second accessory.

As noted above, other accessories and combinations of accessories are possible. Other accessories can include a radio, a powered external speaker, a compass, a global positioning system (GPS), a storage unit, a clock, a pedometer, a power-generating unit, and an alarm. The storage unit can be included with medicines and/or first aid supplies. In various combinations, preferred accessory combinations include a flashlight and speaker combination or a flashlight with radio combination serving as the first accessory 20 and second accessory 30.

In a method for configuring a beverage bottle with accessories, the method comprises coupling one or more accessories to a beverage bottle along a long axis of the bottle. The coupling step can include threading one end of an accessory to a complementary threaded portion formed on one end of the beverage bottle to form an aggregate device defining a common peripheral (e.g. laterally cylindrical) boundary. A first light source may be oriented within the accessory to shine upward into a cavity of the beverage bottle and out non-opaque sides of the bottle to form a diffuse lantern effect. A second light source may be oriented within the accessory to shine outward away from the beverage bottle cavity, opposite to the first light source, to form a flashlight effect. A button is then configured on the accessory to actuate both the first light source and the second light source.

Having described and illustrated the principles of the invention in a preferred embodiment thereof, it should be apparent that the invention can be modified in arrangement and detail without departing from such principles. We claim all modifications and variation coming within the spirit and scope of the invention.

What is claimed is:

1. A configurable beverage container comprising:

a container body defining a central axis and bounded by sides, an openable top, and a bottom defining a cavity in which a liquid can be retained, wherein the container body sides are non-opaque so as to allow light to shine through the sides;

a container body connector located on a lower end of the container body adjacent the container body bottom; and a first accessory having a first accessory connector located on a top end thereof and configured to be coupled to the container body connector along a long axis of the container body, wherein the first accessory includes an inwardly-facing light source configured to shine upward into the cavity of the container body and outward through the non-opaque sides of the container body to thereby illuminate liquid stored within the cavity, wherein the first accessory further includes an outwardly-facing light source arranged in the first accessory on a side opposite the top end on which the first accessory connector is located.

2. A configurable beverage container comprising a cylindrical container body defining a central axis and bounded by non-opaque cylindrical sides, an openable top, and a bottom defining a cavity in which a liquid can be retained; and a first accessory having a first accessory connector located on a top end thereof and configured to be coupled to the bottom of container body along a long axis of the container body, wherein the first accessory includes a flashlight having an outwardly-facing light source and a lantern having an inwardly-facing light source configured to cast light up into the cavity and out the non-opaque cylindrical sides of the container body.

3. The configurable beverage container of claim 2, further including:

a container body connector located adjacent the bottom of the container body defined by female threaded portions formed on inside walls forming a periphery of the bottom of the container body; and a first accessory connector located adjacent the top end of the first accessory defined by male threaded portions formed on outside walls forming a periphery of the top portion of the first accessory, wherein the male threaded portion of the first accessory couple to the female threaded portion of the container body to form an aggregate device bound by a common cylindrical periphery.

4. The configurable beverage container of claim 3, further including a connector located adjacent a bottom end of the first accessory defined by female threaded portion formed on inside walls forming a periphery of the bottom end of the first accessory, wherein the female threaded portion of the first accessory is identical to the female threaded portion of the container body.

5. The configurable beverage container of claim 4, the container further including a second accessory having a second accessory connector located on a top end thereof and configured to be coupled to the connector located on the bottom end of the first accessory along a long axis of the container body, the second accessory connector is a male threaded portion formed on outside walls forming a periphery of a top portion of the second accessory, and wherein the male threaded portion of the second accessory connector is identical to the male threaded portion of the first accessory connector so that the first and second accessories can be interchanged.

6. A method for configuring a beverage bottle with accessories, the method comprising:

coupling at least one accessory to a beverage bottle along a long axis of a beverage bottle;

orienting a first light source within the at least one accessory coupled to the beverage bottle to shine upward into a cavity of the beverage bottle and out non-opaque sides of the bottle to form a diffuse lantern effect;

orienting a second light source within the at least one accessory to shine outward away from the beverage bottle cavity, opposite to the first light source, to form a flashlight effect; and configuring a button on the at least one accessory to actuate both the first light source and the second light source.

* * * * *